US011920462B2

(12) United States Patent
Al-Dhafeeri et al.

(10) Patent No.: US 11,920,462 B2
(45) Date of Patent: Mar. 5, 2024

(54) WATER BREAKTHROUGH IN HYDROCARBON WELLBORES

(71) Applicants: Saudi Arabian Oil Company, Dhahran (SA); Kuwait Gulf Oil Company, Ahmadi (KW)

(72) Inventors: Abdullah M. Al-Dhafeeri, Al Khobar (SA); Cornel Dodan, Al Khafji (SA); Rashed H. Al-Obaid, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/451,432

(22) Filed: Oct. 19, 2021

(65) Prior Publication Data

US 2023/0123032 A1 Apr. 20, 2023

(51) Int. Cl.

| | |
|---|---|
| ***E21B 43/32*** | (2006.01) |
| ***E21B 47/06*** | (2012.01) |
| ***E21B 47/10*** | (2012.01) |

(52) U.S. Cl.

CPC ..... *E21B 47/06* (2013.01); *E21B 47/10* (2013.01); *E21B 2200/20* (2020.05)

(58) Field of Classification Search

CPC ..... E21B 41/0092; E21B 47/10; E21B 43/32; E21B 43/34; E21B 43/38; E21B 2200/20; E21B 2200/22

See application file for complete search history.

(56) References Cited

U.S. PATENT DOCUMENTS

| | | | | |
|---|---|---|---|---|
| 10,669,810 | B2 * | 6/2020 | Egbe | E21B 47/10 |
| 2007/0016389 | A1 * | 1/2007 | Ozgen | E21B 49/00 703/10 |
| 2008/0262737 | A1 * | 10/2008 | Thigpen | G01V 1/40 702/9 |

(Continued)

OTHER PUBLICATIONS

Al-Dhafeeri et al. "Lessons Learned from Tubing Leaks in ESP Completion at Offshore Field," IPTC-20032, presented at the International Petroleum Technology Conference, Jan. 2020, 20 pages.

(Continued)

*Primary Examiner* — Kenneth L Thompson

(74) *Attorney, Agent, or Firm* — Fish & Richardson P.C.

(57) ABSTRACT

Disclosed are methods, systems, and computer-readable medium to perform operations including: generating, based on production data for a wellbore, (i) a water-oil-ratio with respect to time (WOR) dataset for the wellbore, (ii) a time-derivative dataset (WOR') of the WOR dataset; generating a WOR log-log plot of the WOR dataset and a WOR' log-log plot of the WOR' dataset; identifying at least one trend in the WOR log-log plot and the WOR' log-log plot; determining, based on the at least one identified trend, a first type of water breakthrough; generating, based on pressure data from a build-up pressure test in the wellbore, a log-log plot of time-derivative pressure data with respect to time (P'); determining, based on the P' log-log plot, a second type of water breakthrough; correlating the first and second type of water breakthrough; and determining, based on the correlation, whether to perform a water treatment for the wellbore.

20 Claims, 13 Drawing Sheets

(56) References Cited

U.S. PATENT DOCUMENTS

| | | | | |
|---|---|---|---|---|
| 2014/0318234 | A1* | 10/2014 | Zenith | E21B 49/008 73/152.29 |
| 2016/0054713 | A1* | 2/2016 | Foss | E21B 41/00 700/282 |
| 2016/0222765 | A1* | 8/2016 | Nooruddin | G06F 17/10 |
| 2016/0273315 | A1* | 9/2016 | Carvajal | E21B 41/0092 |
| 2017/0363088 | A1 | 12/2017 | Nguyen et al. | |
| 2018/0171788 | A1* | 6/2018 | Waid | E21B 49/088 |
| 2018/0313807 | A1* | 11/2018 | Michael | E21B 49/08 |
| 2018/0320504 | A1* | 11/2018 | Gunnerud | E21B 43/122 |
| 2019/0093469 | A1* | 3/2019 | Williams | E21B 44/00 |
| 2019/0162053 | A1* | 5/2019 | Le Ravalec | E21B 41/00 |
| 2020/0080407 | A1* | 3/2020 | Gunnerud | E21B 47/008 |

OTHER PUBLICATIONS

Li et al., "Condition Monitoring and Fault Diagnosis of Electric Submersible Pump Based on Wellhead Electrical Parameters and Production Parameters," System Science & Control Engineering, 2018, 6(3):253-261, 10 pages.

* cited by examiner

WATER BREAKTHROUGH IN HYDROCARBON WELLBORES

TECHNICAL FIELD

This description relates to methods and systems for water source identification in hydrocarbon wellbores.

BACKGROUND

In the oil and gas industry, increased water production can detrimentally affect the economic life of hydrocarbon producing wells and can cause problems in the oilfield, such as scale deposition, fines migration, and corrosion. Undesirable water production can occur in a variety of situations, such as water coning, water cresting, and bottom water channeling at the wellbore. Undesirable water production can also result from a water-producing zone communicating with the oil- or gas-producing zone through fractures, high-permeability streaks, or fissures. The presence of a thief zone (also referred to as a "super-K permeability zone" or a channel with high absolute permeability) can cause water breakthrough problems during hydrocarbon extraction.

SUMMARY

Identifying the dominant reservoir water production mechanism (for example, water coning, water channeling, or both) is an important factor in water control in a wellbore. For example, successful water shutoff treatments depend on accurately diagnosing the water production mechanism in a wellbore. In practice, a log-log plot of a water-oil-ratio (WOR) with respect to production time is used to diagnose water production. However, this plot, also referred to as a WOR plot, is limited to explaining a reservoir response in terms of flow geometry.

The present disclosure develops a multivariate relation between a WOR plot, a time-derivative plot (WOR') of the WOR plot, and a pressure derivative (P') plot. The pressure derivative plot is, for example, obtained from a pressure transient analysis (PTA) of build-up pressure in a well testing technique. The present disclosure also describes methods and systems that use the relationship between the WOR plot, the WOR' plot, and the P' plot to identify a reservoir water production mechanism in a wellbore. The results from the different plots can be interchanged when identifying the water source.

Aspects of the subject matter described in this specification may be embodied in methods that include the operations for determining a water breakthrough type in a wellbore. In accordance with one aspect of the present disclosure, a method for determining a water breakthrough type in a wellbore is disclosed. The method involves generating, based on production data for a wellbore, (i) a water-oil-ratio with respect to time (WOR) dataset for the wellbore, and (ii) a time-derivative dataset (WOR') of the WOR dataset; generating a WOR log-log plot of the WOR dataset and a WOR' log-log plot of the WOR' dataset; identifying at least one trend in the WOR log-log plot and the WOR' log-log plot; determining, based on the at least one identified trend, a first type of water breakthrough; generating, based on pressure data from a build-up pressure test in the wellbore, a log-log plot of time-derivative pressure data with respect to time (P'); determining, based on the P' log-log plot, a second type of water breakthrough; correlating the first and second type of water breakthrough; and determining, based on the correlation, whether to perform a water treatment for the wellbore.

The previously-described implementation is implementable using a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium. These and other embodiments may each optionally include one or more of the following features.

In some implementations, the first type of water breakthrough and the second type of water breakthrough are at least one: a coning effect or a channeling effect.

In some implementations, correlating the first type of water breakthrough and the second type of water breakthrough involves: comparing the first type of water breakthrough and the second type of water breakthrough; and determining, based on the comparison, that the first and second type of water breakthrough are identical.

In some implementations, determining, based on the correlation, whether to perform a water treatment for the wellbore involves in response to determining that the first and second type of water breakthrough are identical, determining to perform the water treatment for the wellbore.

In some implementations, determining, based on the at least one identified trend, a first type of water breakthrough involves comparing the at least one identified trend to a set of predetermined shapes, each predetermined shape associated with a respective water breakthrough type; determining that the at least one identified trend has a threshold level of similarity to a first predetermined shape; and determining that the respective water breakthrough type of the first predetermined shape is the first type of water breakthrough.

In some implementations, the set predetermined shapes include a first predetermined WOR shape indicative of a channeling effect, where the first predetermined WOR shape is indicative of an increasing WOR; a second predetermined WOR shape indicative of a coning effect one, wherein the second predetermined WOR shape is indicative of a decreasing WOR; a first predetermined WOR' shape indicative of a channeling effect, wherein the first predetermined WOR' shape has a constant positive slope; and a second predetermined WOR' shape indicative of a coning effect, wherein the second predetermined WOR' shape has a constant negative slope.

In some implementations, determining, based on the P' plot, a second type of water breakthrough involves comparing a shape of the P' plot to a set of predetermined shapes, each predetermined shape associated with a respective water breakthrough type; determining that a first predetermined shape matches the shape of the P' plot; and determining that the respective water breakthrough type of the first predetermined shape is the second type of water breakthrough.

In some implementations, determining, based on the correlation, whether to perform a water treatment for the wellbore involves determined to perform the water treatment for the wellbore, and the method further involves determining, based on the correlation, a type of water treatment.

In some implementations, the method further involves controlling at least one drilling tool to perform the determined type of water treatment.

The subject matter described in this specification can be implemented in particular implementations so as to realize one or more of the following advantages. The disclosed methods can be used to identify a water source in a wellbore (for example, an oil or gas wellbore). In particular, unlike existing techniques, the disclosed methods are capable of identifying water breakthrough in a wellbore, whether the wellbore is located in a fractured formation or in a formation connected with matrix permeability and streak (super-K) layers. By accurately identifying the water source, the disclosed methods also determine an optimal water or gas shutoff treatment. Additionally, the disclosed methods design a conformance treatment in the wellbore based on the identified water source. The disclosed methods also capture fractures or other high permeability anomalies in order to apply proper water shutoff zones in direct contact with the wellbore. Further, the disclosed methods can be used to control the production rate of an existing wellbore in order to delay or minimize water breakthrough. Additionally, the disclosed methods can be used to select a location of a new well or side track trajectories. Yet further, the disclosed methods can be used to select a well type (for example, vertical, deviated or slanted well) of a new wellbore. The disclosed methods can be applied to any reservoir system undergoing water encroachment. The pressure data can also offer insights into flow behavior near the wellbore and farther into the reservoir.

The details of one or more embodiments of these systems and methods are set forth in the accompanying drawings and the description below. Other features, objects, and advantages of these systems and methods will be apparent from the description and drawings, and from the claims.

BRIEF DESCRIPTION OF THE DRAWINGS

Like reference numbers and designations in the various drawings indicate like elements.

DETAILED DESCRIPTION

This disclosure describes methods and systems for determining a water breakthrough type in a wellbore, and for performing mitigating actions based on the water breakthrough type. In one embodiment, a method involves determining a water breakthrough type in a wellbore based on a water-oil-ratio (WOR) dataset with respect to time, a time-derivative dataset (WOR') of the WOR, and a derivative of pressure buildup in the wellbore (P') dataset with respect to time. In one example, a water source identification (WSI) system generates the WOR dataset, the WOR' dataset, and the P' dataset for the wellbore. The WSI system then identifies the water production mechanism in the wellbore based on at least one pattern identified in at least one dataset. The observed pattern(s) reflect the displacement behavior of water encroachment with respect to both the reservoir and the wellbore. The WSI system can also use properties of the datasets to determine properties of heterogeneous systems, including a permeability streak (e.g., super-K), a rock matrix, multi-layers, fractures, and fault effects in terms of cross flow and communication between formations.

Accordingly, the WSI system uses a combination of the generated WOR, WOR', and P' datasets to understand reservoir behavior. For example, the generated datasets are used for characterizing a water flow path geometry in reservoirs by describing features of water flow, such as water coning, water channeling, or a combination of both. As such, the present disclosure provides a qualitative analysis in terms of monitoring changes in wellbore conditions, reservoir properties, as well as characterizing boundary conditions for diagnosing the water source in a wellbore.

Figure 1:
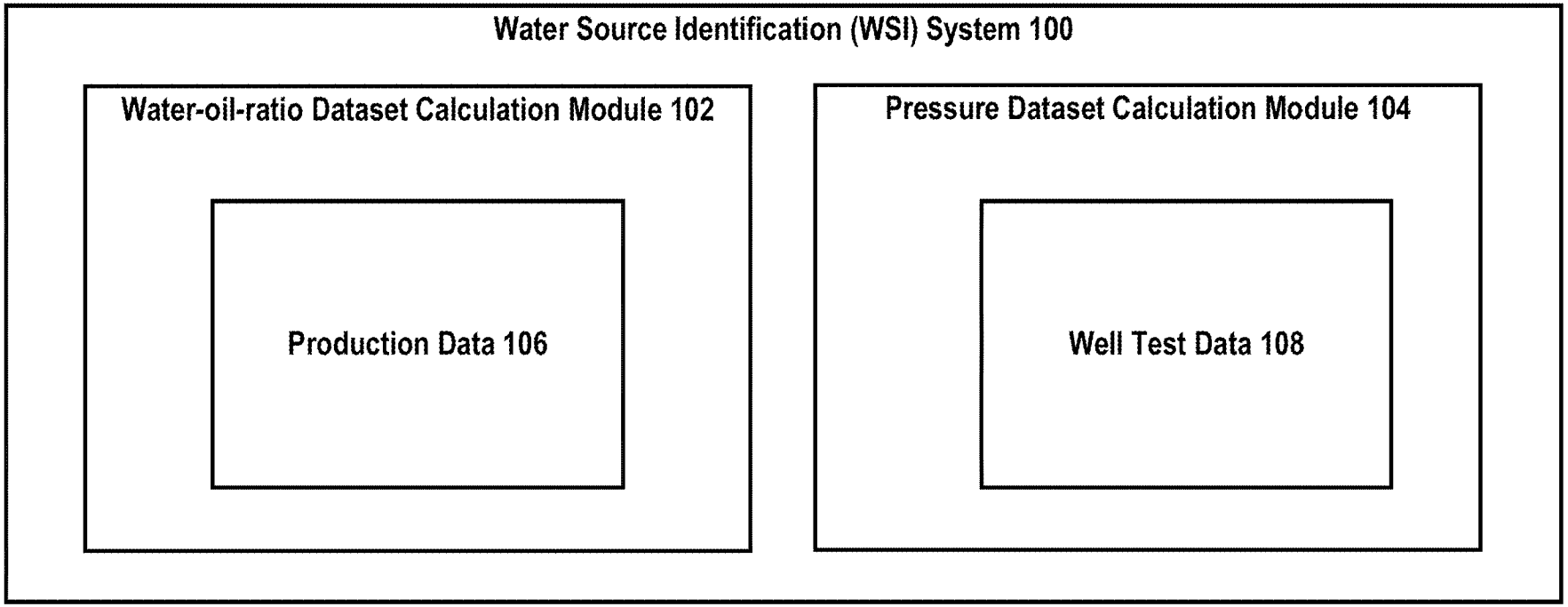
FIG. 1 illustrates an example water source identification (WSI) system, according to some implementations of the present disclosure.

FIG. 1 illustrates an example water source identification (WSI) system 100, according to some implementations. As shown in FIG. 1, the WSI system 100 includes a water-oil-ratio dataset (WOR) calculation module 102 and a pressure dataset (P) calculation module 104. The WIS 100 is configured to identify a water source for a wellbore based on a WOR dataset, a WOR' dataset, and a P' dataset for that wellbore. In some examples, the WSI system 100 is a computer system that is the same as, or similar to, system 800 of FIG. 8. Note that the WSI system 100 is shown for illustration purposes only, as the system can include additional components and/or have one or more components removed without departing from the scope of the disclosure. Further, note that the various components of the WSI system 100 can be arranged and connected in any manner.

In some embodiments, the WOR calculation module 102 is configured to calculate a water-oil-ratio (WOR) dataset with respect to time for a wellbore. In an example, the WOR calculation module 102 calculates the WOR dataset based on historical production data for the wellbore. In particular, the historical production data can be historical analysis charts in semi-steady state regimes. In the WIS system 100, the historical production data is stored as production data 106. In addition to calculating the WOR dataset for the wellbore, the WOR calculation module 102 is also configured to generate a graphical plot of the WOR dataset. In one example, the WOR calculation module 102 generates a log-log plot of the WOR dataset (for example, the WOR log-log plot 412 shown in FIG. 4B). Additionally, the WOR calculation module 102 is configured to calculate a time-derivative of the WOR dataset to generate a time-derivate WOR (WOR') dataset with respect to time. The WOR calculation module 102 can also generate a graphical plot of the WOR' dataset, such as a log-log plot of the WOR' dataset (for example, the WOR' log-log plot 414 shown in FIG. 4B).

In some embodiments, the P calculation module 104 is configured to generate a buildup pressure (P) dataset with respect to time for a wellbore. In one example, the P dataset is generated based on well test data 108 from a well test performed in the wellbore. A "well test" refers to data acquisition processes that can be performed at various stages of the wellbore's life. During a testing period, a response of a reservoir to changes in wellbore conditions resulting from either production or injection is monitored. The reservoir response is controlled by different parameters such as permeability, fracture properties, wellbore storage, boundary conditions, and/or skin effect. A mathematical model, which can be analytical or numerical, is developed to explain reservoir behavior by changing the different parameters and observing the response. A better physical understanding of these parameters can lead to appropriate interpretations for reservoir behavior.

In some examples, the well test data 108 is generated using a transient well test that obtains information about a reservoir by analyzing a pressure response caused by a change in a production rate of the wellbore. The well test analysis in a transient condition provides information related to the changes in reservoir properties, such as formation permeability and fluid saturation. This information is indicative of a reservoir's response to dynamic disturbances made to the formation at the time of testing. The results of the analysis reveal instantaneous information indicative of the reservoir properties in an area of interest. The transient well test can also provide information related to changes in the rock and fluid properties, such water saturation in an investigated wellbore or a drainage radius.

In some embodiments, the P calculation module 104 is configured to generate a time-derivative of the P dataset. Specifically, a pressure derivative technique is used to analyze the pressure buildup data based on a derivative of the data with respect to time. This technique can be used in both homogeneous and heterogeneous reservoirs. The use of the pressure derivative technique for interpreting pressure behavior diminishes the uniqueness problem in type-curve matching and provides better confidence in measured data. Additionally, features such as high permeability zones and fracture/fault networks, which can be difficult to distinguish using existing techniques, are easier to recognize using the pressure derivative technique. However, the pressure derivative analysis of transient tests depends on the quality of the data. Therefore, it is preferable for the mechanical tools used to obtain pressure data to be equipped to eliminate noise.

Figure 2A:
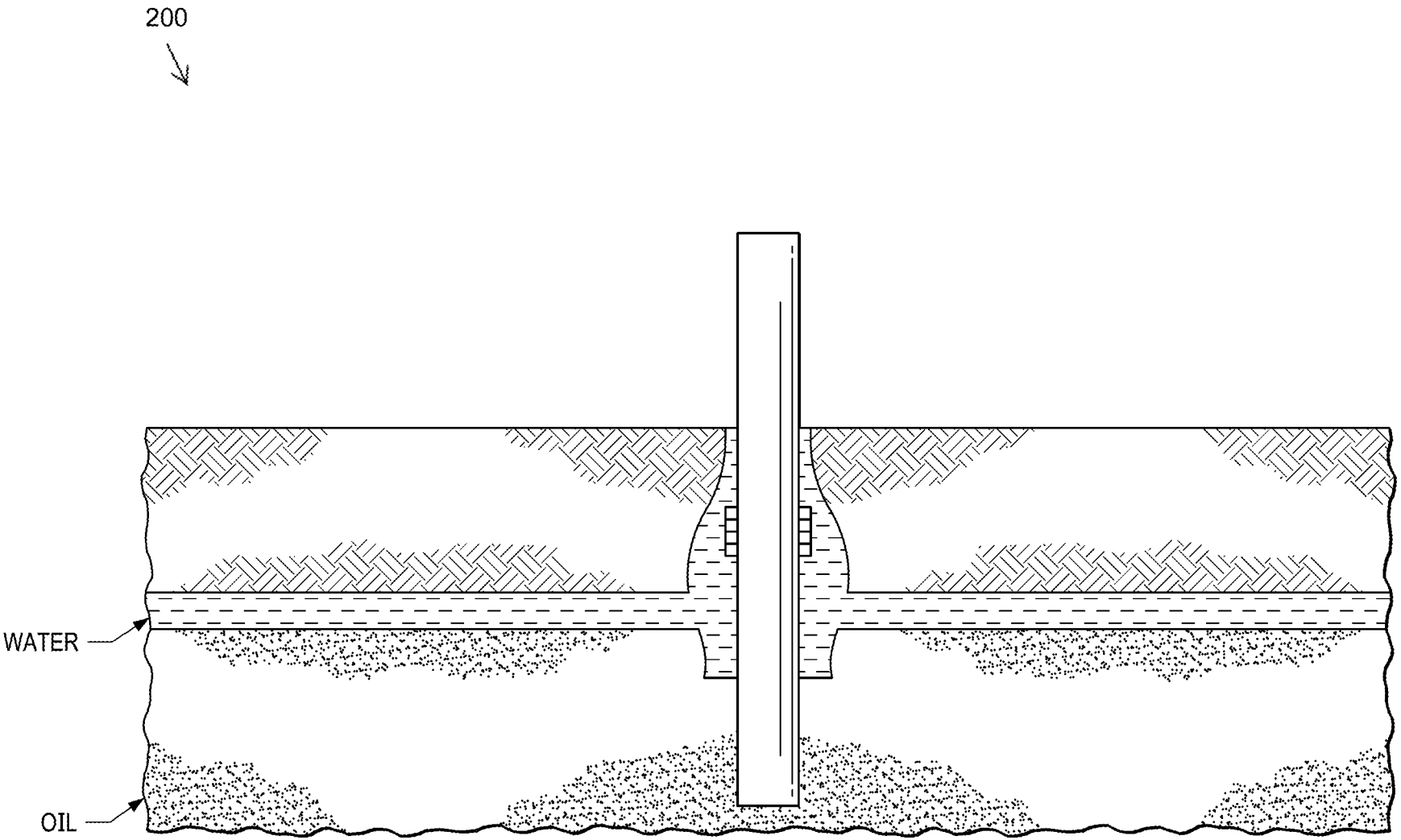
FIG. 2A, FIG. 2B, and FIG. 2C each illustrate a wellbore experiencing a respective water breakthrough problem that can be identified by the WSI system of FIG. 1, according to some implementations of the present disclosure.
Figure 2B:
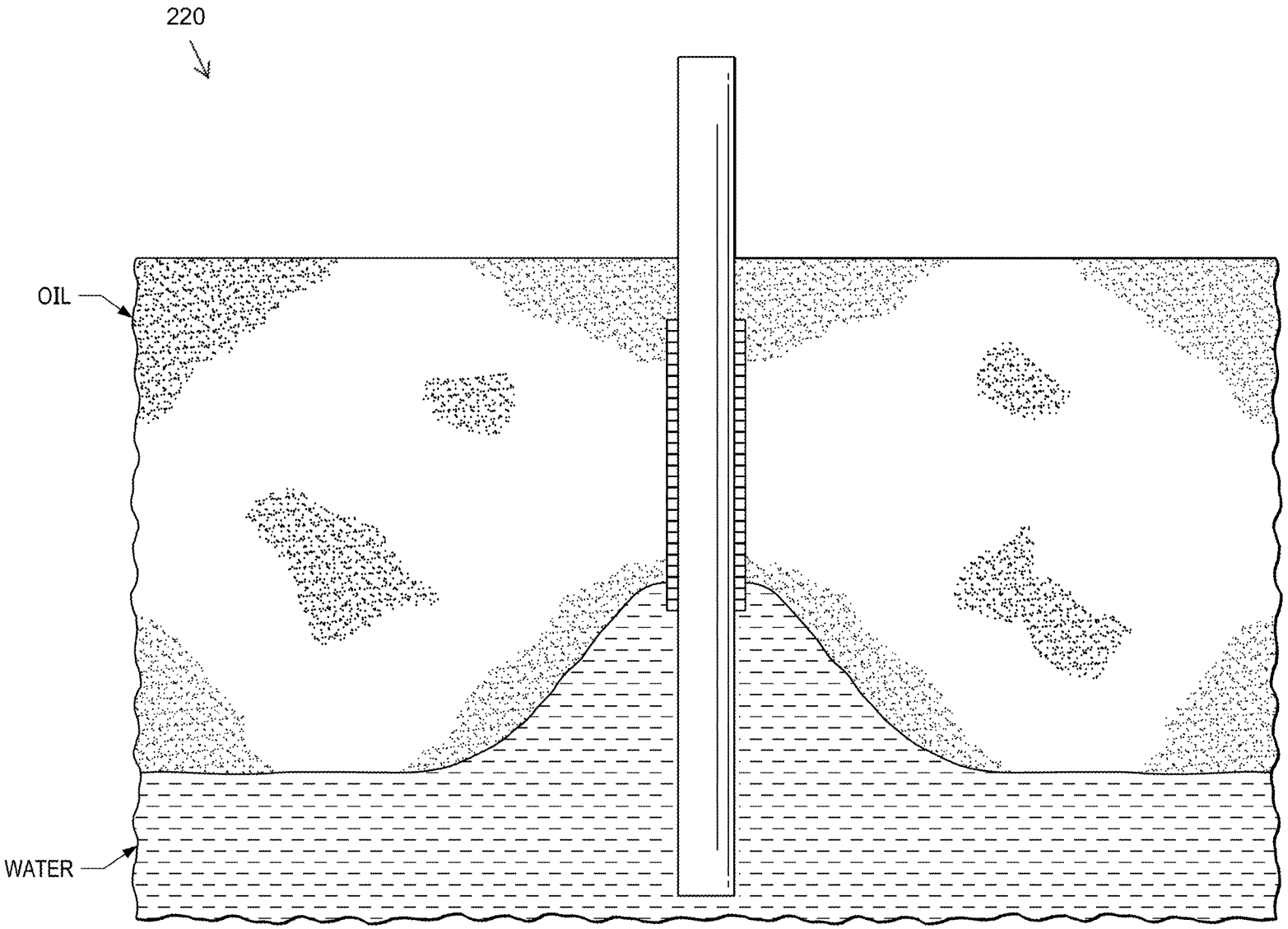
Figure 2C:
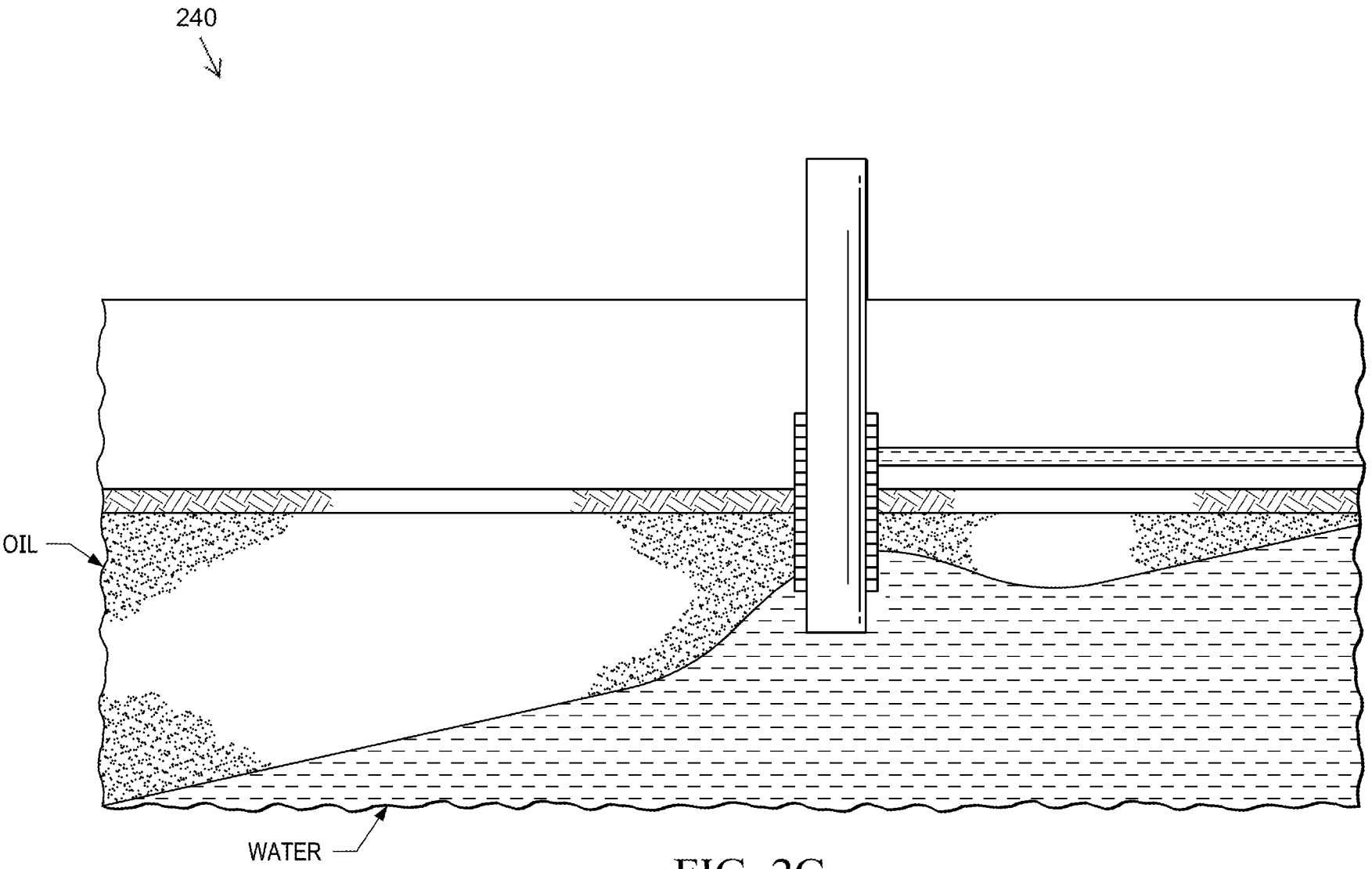

FIG. 2A, FIG. 2B, and FIG. 2C each illustrate a wellbore experiencing a respective water breakthrough problem that can be identified by the WSI system 100, according to some implementations of the present disclosure. In particular, FIG. 2A illustrates a well configuration 200 with water breakthrough due to a channeling problem. In this example, a layer with high permeability connected to the wellbore can accelerate excessive water production in the wellbore. FIG. 2B illustrates a well configuration 220 with water breakthrough due to a coning problem. In this example, a bottom water aquifer with a high ratio of permeability (vertical and horizontal) is connected to the wellbore, which accelerates excessive water production in the wellbore. FIG. 2C 230 illustrates a well configuration with water breakthrough due to a combined channeling-coning effect. In this example, both a layer with high permeability and a bottom water aquifer with a high ratio of permeability (vertical and horizontal) are connected to a wellbore, which accelerates excessive water production in the wellbore. As described herein, the WSI system 100 of FIG. 1 can identify at least these types of water breakthrough problems.

Figure 3:
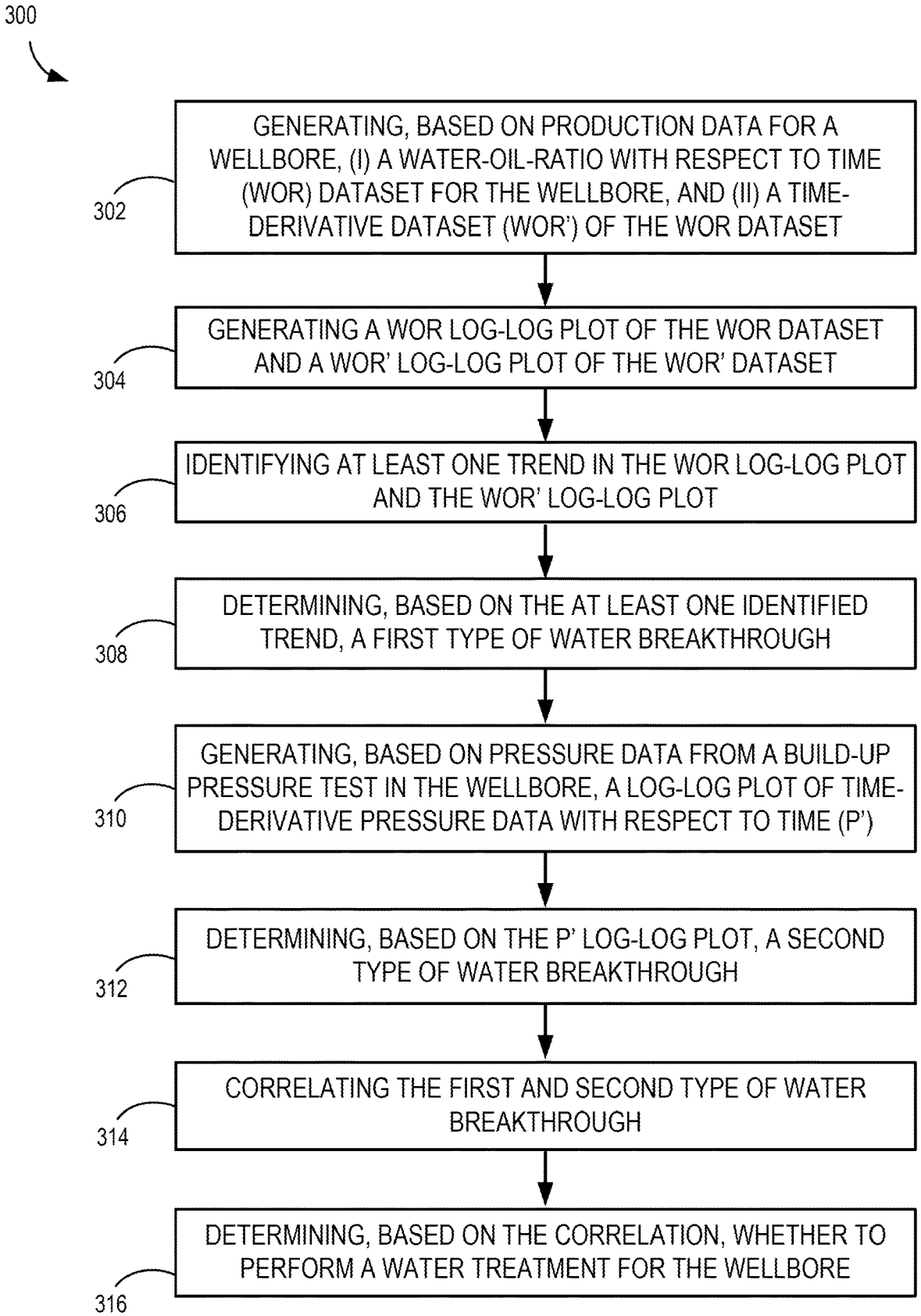
FIG. 3 illustrates a flowchart of an example method, according to some implementations of the present disclosure.

FIG. 3 illustrates a flowchart of an example method 300 for determining a type of water breakthrough problem for a wellbore, according to some implementations. For clarity of presentation, the description that follows generally describes method 300 in the context of the other figures in this description. For example, the method 300 can be performed by the computer system 800 of FIG. 8. However, it will be understood that the method 300 may be performed, for example, by any suitable system, environment, software, and hardware, or a combination of systems, environments, software, and hardware, as appropriate. In some implementations, various steps of the method 300 can be run in parallel, in combination, in loops, or in any order.

In some embodiments, the method 300 relies on combined diagnostic WOR' and P' plots to identify the water production in terms of following aspects. First, a source of water breakthrough into the wellbore can be determined. The source can be a channeling effect, a coning effect, or a combination of both (that is, channeling-coning effect). Second, a movement and severity of the produced water with respect to an oil production profile can be determined. Third, a water distribution around the wellbore connected to the reservoir response based on a change with time can be determined. Fourth, reservoir features such as fractures, faults, and high permeability streaks can be captured in order to illustrate fluid flow behaviors in heterogeneous formations. Fifth, a speed of the produced water breakthrough into the wellbore due can be determined (for example, rapid or slow). Sixth, the curves can provide the timing of water entrance linked to the type of water production mechanism.

In some embodiments, based on heterogeneities properties (for example, permeability and fracture/fault conductivity), the slopes of WOR and WOR' will be different. For high permeability or fracture/fault conductivity, a sharp increase in the slope of WOR and WOR' can be observed. The P' will have different signature for each type of heterogeneity and additional parameters can be identified for different types of reservoir or well heterogeneity.

Turning to the method 300, at step 302, the method 300 involves generating, based on production data for a wellbore, (i) a water-oil-ratio with respect to time (WOR) dataset for the wellbore, and (ii) a time-derivative dataset (WOR') of the WOR dataset. In one example, the production data is historical analysis charts in semi-steady state regimes for the wellbore.

At step 304, the method 300 involves generating a WOR log-log plot of the WOR dataset and a WOR' log-log plot of the WOR' dataset. Example WOR log-log plots and WOR' log-log plots are illustrated in FIG. 4B and FIG. 5B.

At step 306, the method 300 involves identifying at least one trend in the WOR log-log plot and the WOR' log-log plot. In an implementation, identifying the at least one trend in the WOR log and the WOR' log-log plot involves comparing the at least one identified trend to a set of predetermined shapes, each predetermined shape associated with a respective water breakthrough type. As an example, the set of predetermined shapes can include a first predetermined WOR shape indicative of a channeling effect, where the first predetermined WOR shape is indicative of increasing WOR. As another example, the set of predetermined shapes can include a second predetermined WOR shape indicative of a coning effect one, where the second predetermined WOR shape is indicative of a decreasing WOR. As yet another example, the set of predetermined shapes includes a first predetermined WOR' shape indicative of a channeling effect, where the first predetermined WOR' shape has a constant positive slope. As a further example, the set of predetermined shapes can include a second predetermined WOR' shape indicative of a coning effect, where the second predetermined WOR' shape has a constant negative slope.

At step 308, the method 300 involves determining, based on the at least one identified trend, a first type of water breakthrough. In some embodiments, determining, based on the at least one identified trend, a first type of water breakthrough involves: comparing the at least one identified trend to a set of predetermined shapes, each predetermined shape associated with a respective water breakthrough type; determining that the at least one identified trend has a threshold level of similarity to a first predetermined shape; and determining that the respective water breakthrough type of the first predetermined shape is the first type of water breakthrough.

At step 310, the method 300 involves generating, based on pressure data from a build-up pressure test in the wellbore, a log-log plot of time-derivative pressure data with respect to time (P'). In an example, the pressure data with respect to time is generated based on well test data from a well test performed in the wellbore. In particular, the pressure data can be generated from a pressure transient analysis (PTA) of build-up pressure. The time-derivative of the pressure data is calculated and used to generate a log-log plot of the time-derivative pressure data with respect to time.

At step 312, the method 300 involves determining, based on the P' log-log plot, a second type of water breakthrough. In some embodiments, determining, based on the P' plot, a second type of water breakthrough involves: comparing a shape of the P' plot to a set of predetermined shapes, each predetermined shape associated with a respective water breakthrough type; determining that a first predetermined shape matches the shape of the P' plot; and determining that the respective water breakthrough type of the first predetermined shape is the second type of water breakthrough. In one example, a shape of a P' plot that indicates that the value of P' decreases and then gradually approaches a constant value at the end of the buildup period is indicative of a channeling effect. In another example, a shape of a P' plot that indicates that the value of P' starts with a constant value at an early buildup time and then sharply decreases at the end of the buildup period is indicative of a coning effect. As such, the P' plot diagnoses the changes of reservoir properties such as permeability due to the changes in water saturation. This facilitates diagnosing water changes within a well drainage area.

At step 314, the method 300 involves correlating the first and second type of water breakthrough. In some embodiments, correlating the first type of water breakthrough and the second type of water breakthrough involves comparing the first type of water breakthrough and the second type of water breakthrough. In one example, the first and second type of water breakthrough are identical. In another example, the first and second type of water breakthrough are different.

At step 316, the method 300 involves determining, based on the correlation, whether to perform a water treatment for the wellbore. In one example, if the first and second type of water breakthrough are identical, then the method 300 involves determining to perform the water treatment for the wellbore. Conversely, if the first and second type of water breakthrough are different, then the method 300 involves determining not to perform the water treatment for the wellbore.

In some embodiments, the method 300 further involves utilizing a water production profile with respect to time to determine excessive water production development during a lifecycle of the wellbore, and throughout the reservoir.

In some embodiments, the method 300 further involves selecting, based on the determined type of water breakthrough, a type of water treatment for the wellbore. Logically, identification of the produced water problem from wellbores should be implemented prior to attempting a water-shutoff treatment. However, in practice, water production problems are not properly identified and diagnosed. Consequently, attempted water-shutoff treatment have a low success rate. The root causes for the improper diagnosis of produced water problems include:

- Engineers have little resources to perform the best diagnosis analysis with best tools on high number of wells suffered from high water cuts;
- Uncertainty on which diagnostic tools should be implemented prior to a treatment design; and
- Some engineers believe that one method (e.g., cement) is capable of solving all water production problems, while other engineers believe that only one type of water production problem occurs, which results in improper diagnosis of water production problems.

In some embodiments, by properly diagnosing the water production in wellbores, an optimal water shutoff treatment can be selected. In one example, conventional treatments (for example, cement and mechanical devices) are used to treat simple problems, such as casing leaks and flow behind a pipe, in scenarios where cement can be placed for unfractured wells with effective barriers for crossflow. In another example, gelant treatments are used to treat simple problems, such as casing leaks and flow behind a pipe, in scenarios where there are flow restrictions. In yet another example, both gelants and preformed gels are used to treat hydraulic or nature fractures that connect to an active aquifer. In another example, treatments with preformed gels can be considered are used for faults or fractures crossing a deviated or horizontal well, for a single fracture causing channeling between wells, or for a natural fracture system that allows channeling between wells.

In some embodiments, the type of treatment is selected based on the type of water breakthrough. Evaluation of water shutoff treatments is of interest not only for economic objectives, but also for the development and application of effective conformance technology. In on example, conventional treatments (for example, cement and mechanical devices) are used to treat a coning effect. In another example, both gelants and preformed gels are used to treat channeling that connects to an active water aquifer. If the channeling is not connected to an active water aquifer, then a conventional treatment (for example, cement and mechanical devices) used to treat the channeling. For coning-channeling effect, both conventional and chemical treatments can be used to tackle this problem effectively.

In some embodiments, the type of water breakthrough can also be used to make reservoir management decisions. In some examples, the following decisions are made based on the type of water breakthrough:

- whether to perform water shut off all types;
- whether to reduce the production rate for the subject wellbore or nearby wellbores to reduce the water breakthrough;
- selecting the location of new wellbores or side track trajectories; and
- determining the well type, for example, vertical, deviated, or slanted.

In some embodiments, the type of water breakthrough can also be used to select a location of a new well or side track trajectories. In other embodiments, the type of water breakthrough can also be used to select a well type (for example, vertical, deviated or slanted well) of a new wellbore. More specifically, the water breakthrough type is correlated with other reservoir characteristics in order to determine a well placement or a well type. For example, a channeling effect can confirm existence of fractures, high permeability streaks, or both. As such, the design of new wells trajectories or sidetracks will consider features that are identified by the method 300 in order to avoid the intersection of newly drilled wells with confirmed heterogeneities. In some embodiments, one or more drilling tools can be controlled to drill a new well at the selected location.

This disclosure also describes three example scenarios of performing the method 300 to diagnose the water production in wellbores. As described below, at least one of WOR, WOR', and P' plots were generated for the wellbore in each example scenario. These plots are capable of differentiating whether a wellbore is experiencing formation water encroachment due to channeling, coning, or a combination of both (channeling-coning effect).

Figure 4A:
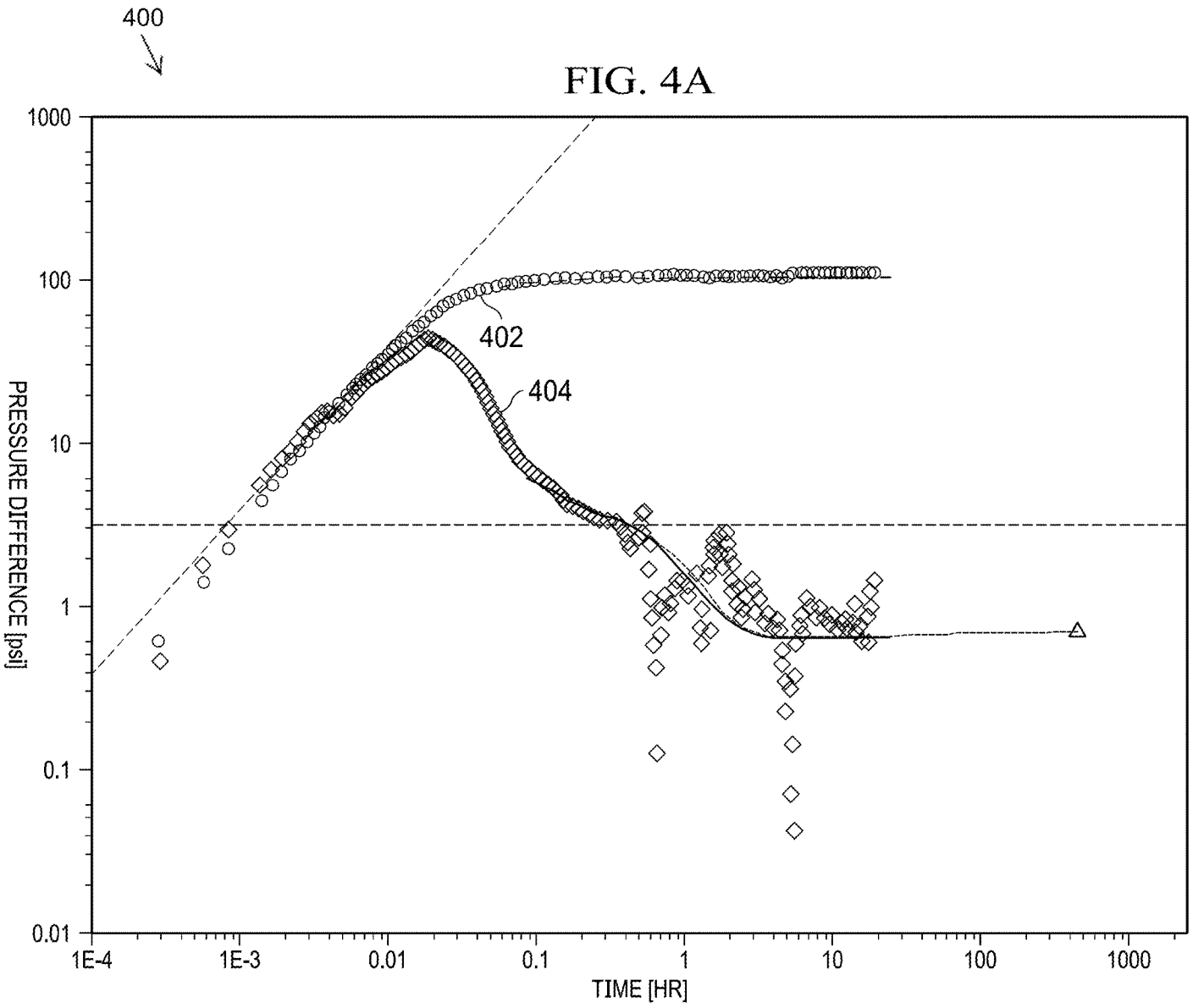
FIG. 4A and FIG. 4B illustrate the results of applying the example method of FIG. 3 to a first wellbore, according to some implementations of the present disclosure.
Figure 4B:
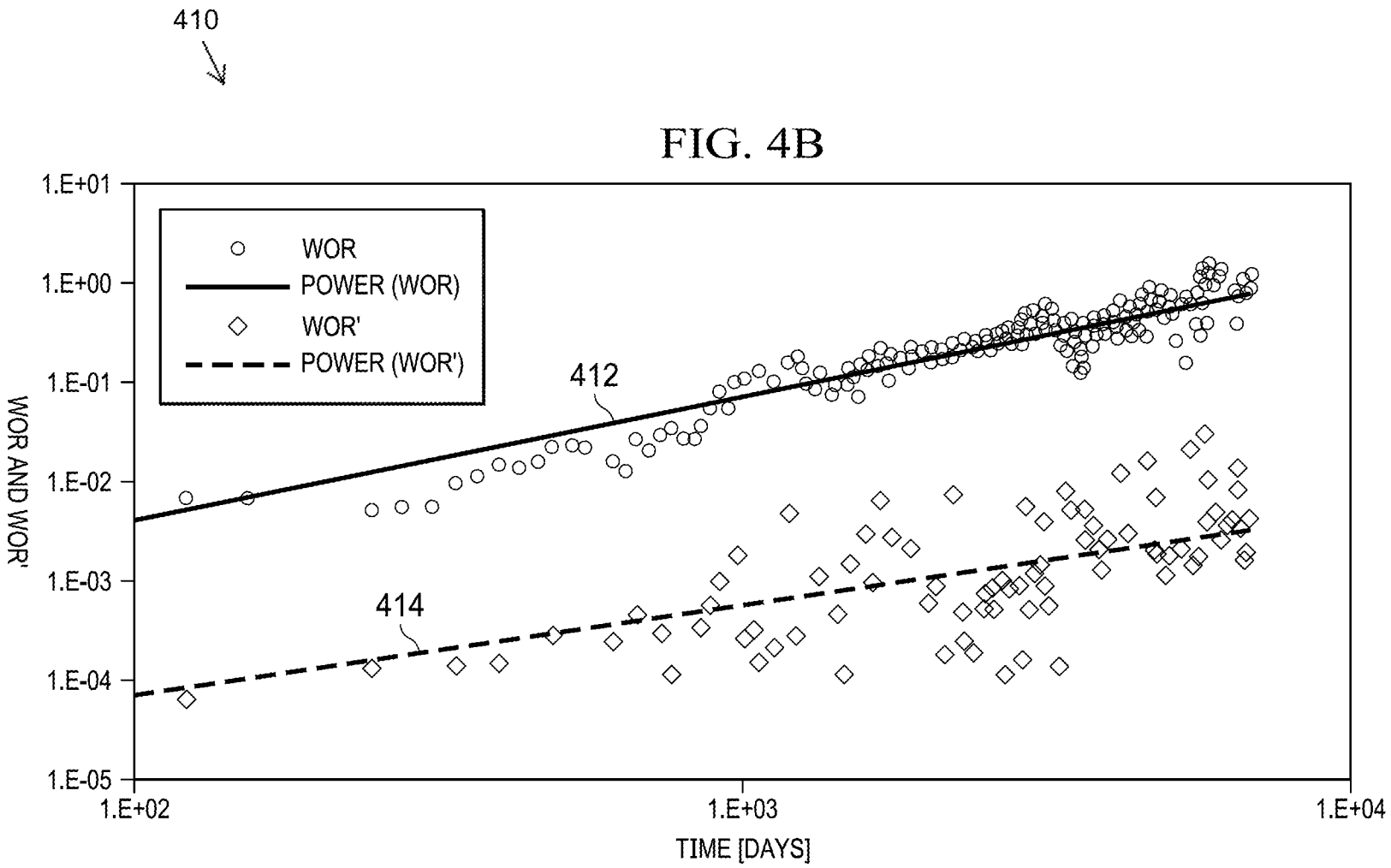

FIG. 4A-4B illustrate the results of applying method 300 to a vertical oil well "A," according to some implementations. Specifically, FIG. 4A illustrates a graph 400 that includes a log-log transient pressure plot 402 and a log-log derivative pressure plot 404 for well A. And FIG. 4B illustrates a graph 410 that includes a log-log WOR plot 412 and a log-log WOR' plot for well A. In this example scenario, a well test analysis is carried out for the well A. A reservoir model is selected for the well A based on water saturation distribution near the wellbore area. In this example, a radial composite reservoir model is selected based on water saturation distribution near the wellbore area. In a first zone of the radial composite reservoir model, oil and water are two separate phases. The first zone is followed by a transition zone due to changes in water saturation. However, at the end of a buildup period (that is, late shut-in time after transition period is completed), a water saturation is nearly a connate water saturation ($S_{wc}$), which illustrates an increase in reservoir permeability (linear flow).

As shown in FIG. 4A, the pressure derivative plot 404 has two horizontal transition periods. Here, a transition period is indicative of changes in water saturation near the wellbore area. Thus, the two horizontal lines indicate two zones with different reservoir properties (permeability). The near wellbore permeability changed due to an increase in water saturation. As described previously, the type of water breakthrough can be identified from the pressure derivative plot 404. In this example, the shape of the pressure derivative plot 404 decreases and then gradually approaches a constant value at the end of the buildup period. As described previously, this shape is indicative of a channeling effect. As such, the derivative plot 404 is indicative of a channeling effect.

FIG. 4A also illustrates a match of field data on the composite-reservoir type curve with an oil water mobility ratio of 0.2 and a distance to the radial discontinuity of 204 ft. The early-time data, up to 0.25 hours, is dominated by a negative half-slope, which represents skin due to partial penetration of the perforation. The calculated skin from the log-log and first semi-log straight line is 6.3 due to limited entry, but it shows that the first zone acting as skin for a flow. The late-time pressure derivative shows transition zone in derivative due to changing in oil water saturation and horizontal stabilization after 8 hours, characterizing infinite-acting radial flow in the high oil saturation phase region.

FIG. 4B illustrates log-log plot 412 of a Water-Oil Ratio (WOR) and a log-log plot 414 of a WOR' with respect to time. As shown in FIG. 4B, the WOR curve 412 increases as time increases. As described previously, the rapid increase in the WOR is indicative of a water breakthrough from a channeling effect. The slope of the WOR from the channeling effect primarily depends on a connate water saturation, an initial water saturation, and a water relative permeability. Based on the WOR curve 412, it can be determined that the increase in the WOR is due to entering a transient period and production depletion of the production zone. The transient period could also be relied on a permeability contrast across thickness zones in terms of reservoir heterogeneity such as fractures/faults and high permeability streak zones.

The WOR' curve 414 can effectivity be used to confirm the presence of channeling problem connected to the wellbore. As shown in FIG. 4B, the WOR' curve 414 has a constant positive slope, which is indicative of a channeling effect. Therefore, the WOR' curve can also be used to determine or confirm the water breakthrough mechanism when production data is provided.

Figure 5A:
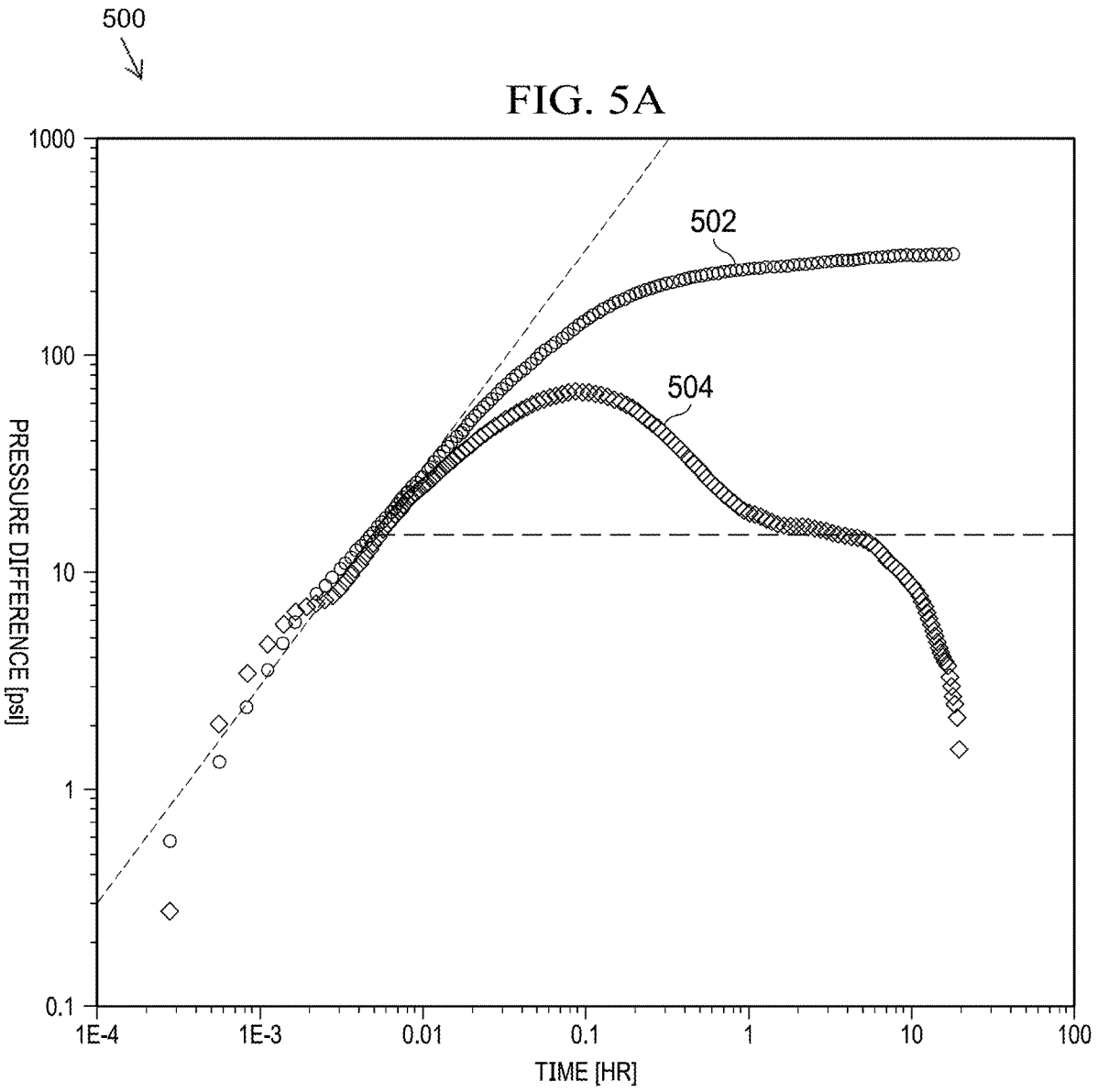
FIG. 5A and FIG. 5B illustrate the results of applying the example method of FIG. 3 to a second wellbore, according to some implementations of the present disclosure.
Figure 5B:
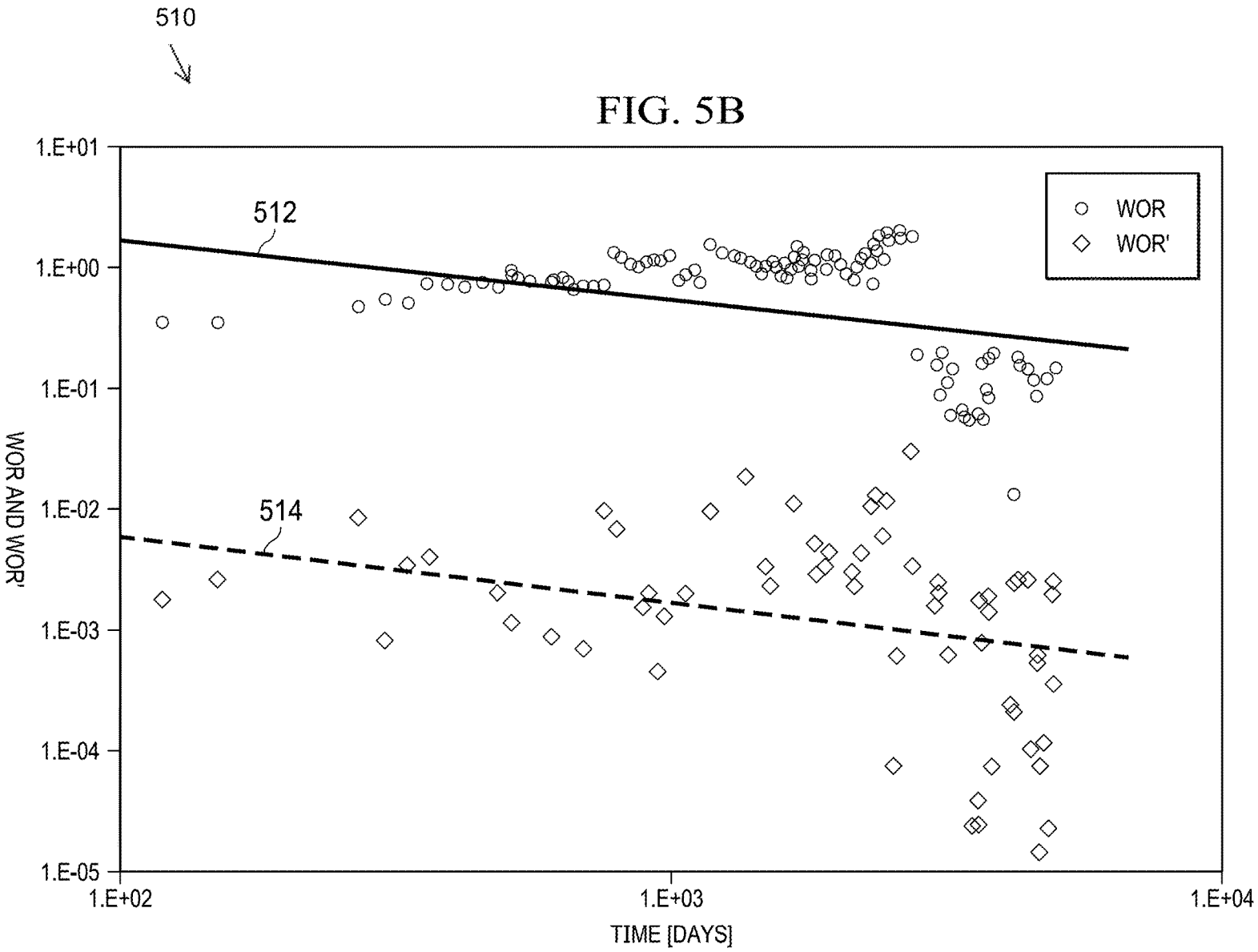

FIG. 5A-5B illustrate the results of applying method 300 to a vertical oil well "B," according to some implementations. Specifically, FIG. 5A illustrates a graph 500 that includes a log-log plot 502 of a pressure in a transient buildup test and a log-log plot 504 of a derivative (P') of the pressure in the transient buildup test. And FIG. 5B illustrates a graph 510 that includes a WOR log-log plot 512 and a WOR' log-log plot 514 for the well B.

As shown in FIG. 5A, the P' log-log plot 504 has two horizontal stabilized periods. The transition period is characteristics of changes water saturation near wellbore area. In this example, the shape of the P' log-log plot 504 starts with a constant value at an early time and then sharply decreases at the end of the period due to a pressure support from a bottom aquifer. As described previously, this shape is indicative of a coning effect. As such, the P' log-log plot 504 can be effectivity used to recognize the presence of coning impact from the bottom aquifer, which causing a water breakthrough.

As shown in FIG. 5B, the WOR plot 512 is decreasing with time. As described previously, the decrease in the WOR indicates a water breakthrough from coning. The slope of WOR from coning is primarily based on connate water saturation, initial water saturation, vertical and horizontal permeability ratio and bottom water drive. Based on the WOR curve, the decrease of WOR could be due to bottom water aquifer impact at the late time.

Additionally, the WOR' plot 514 can be effectivity used to confirm the presence of coning problem connected to the wellbore, which causing a water breakthrough. The WOR' plot 514 illustrates a constant negative slop behavior for a coning effect. Therefore, WOR' (time derivative of the WOR) plot can also be used to identify the water breakthrough mechanism when production data is provided.

Figure 6A:
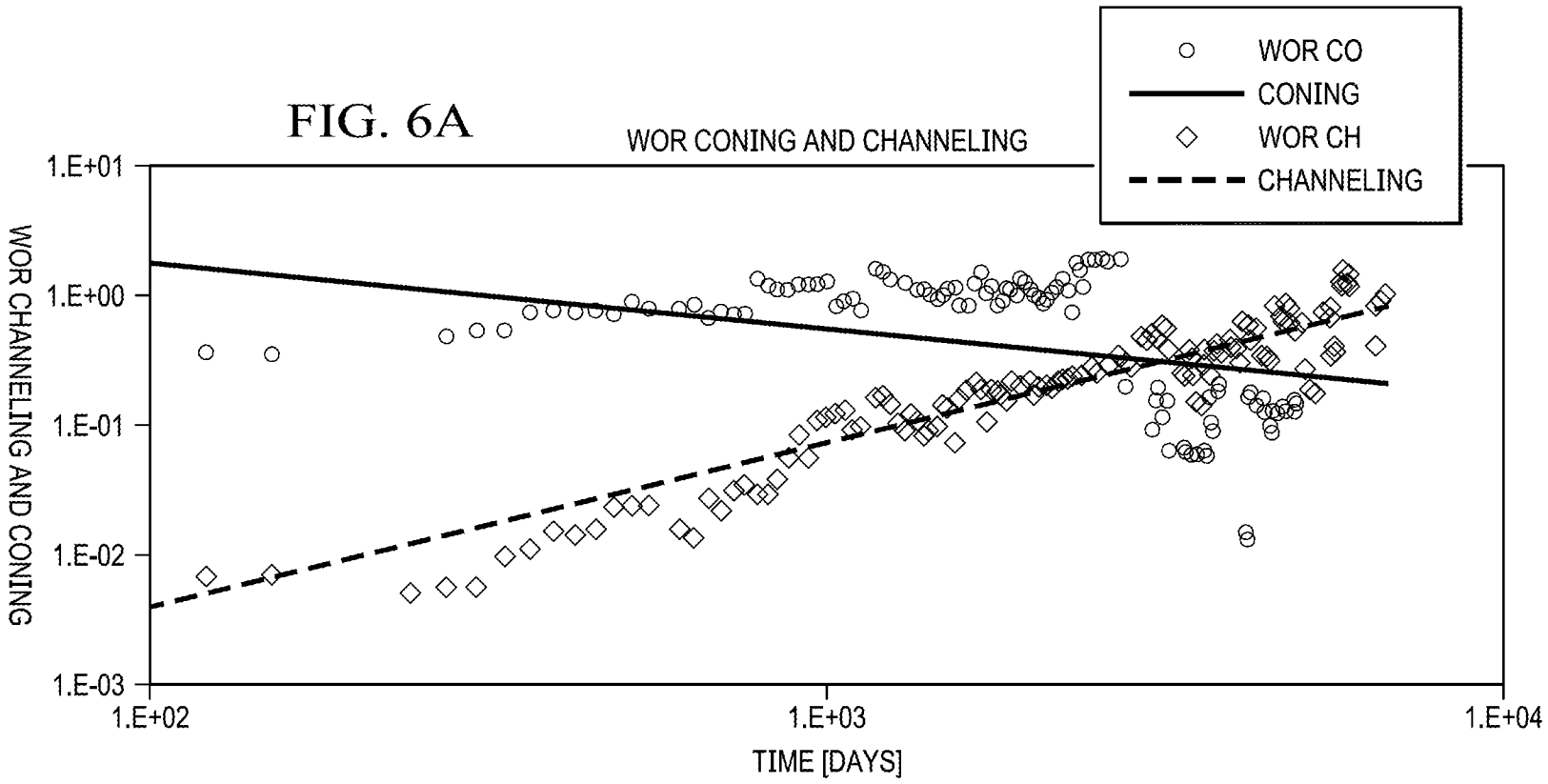
FIG. 6A and FIG. 6B illustrate a comparison for each problem mechanism in terms of WOR and WOR' for water breakthrough for the first and second wellbores, according to some implementations of the present disclosure.
Figure 6B:
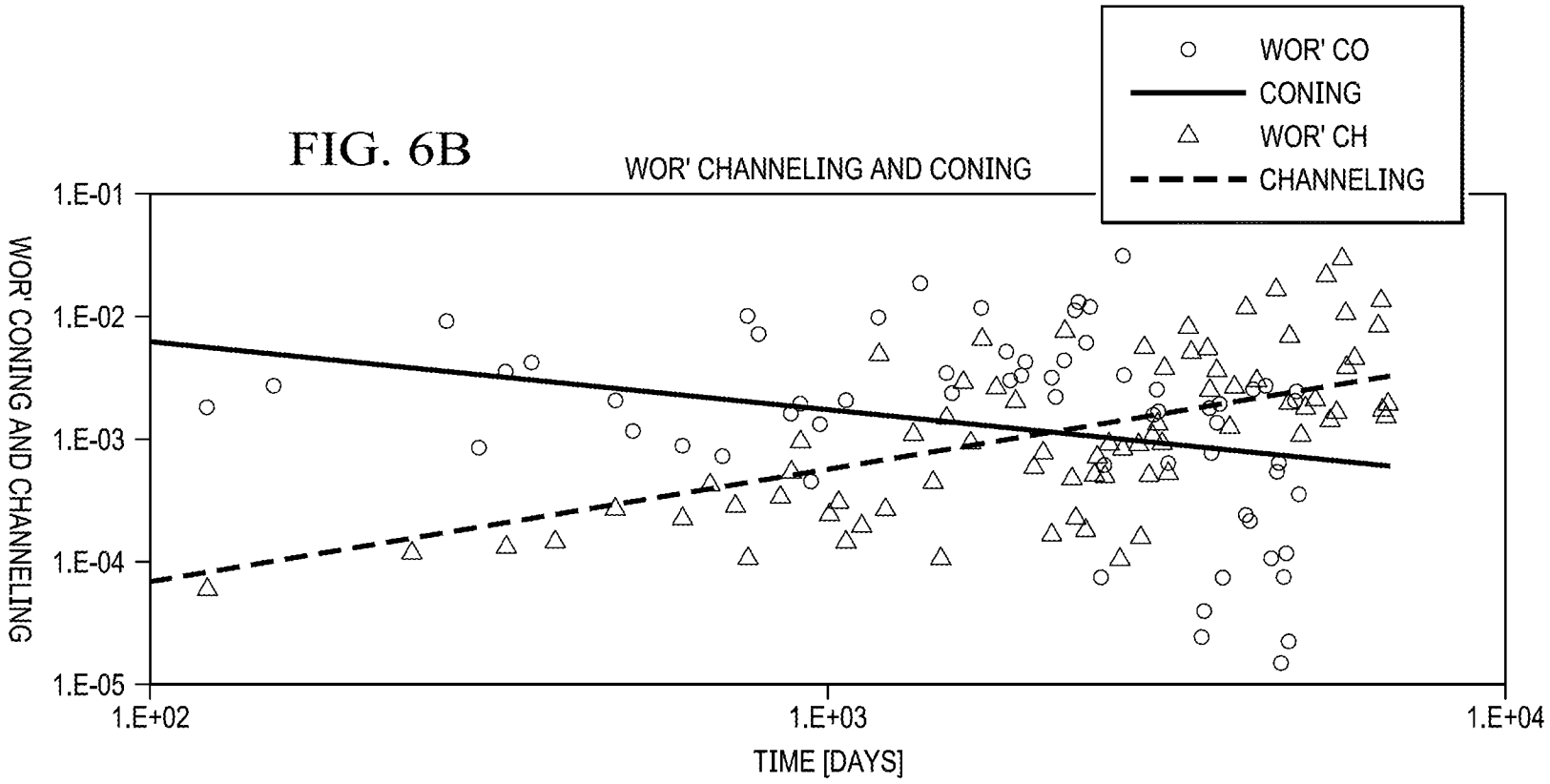

FIG. 6A and FIG. 6B illustrate a comparison for each problem mechanism in terms of WOR and WOR' for water breakthrough issues to show the difference between coning and channeling effects related to wells A and B.

Figure 7:
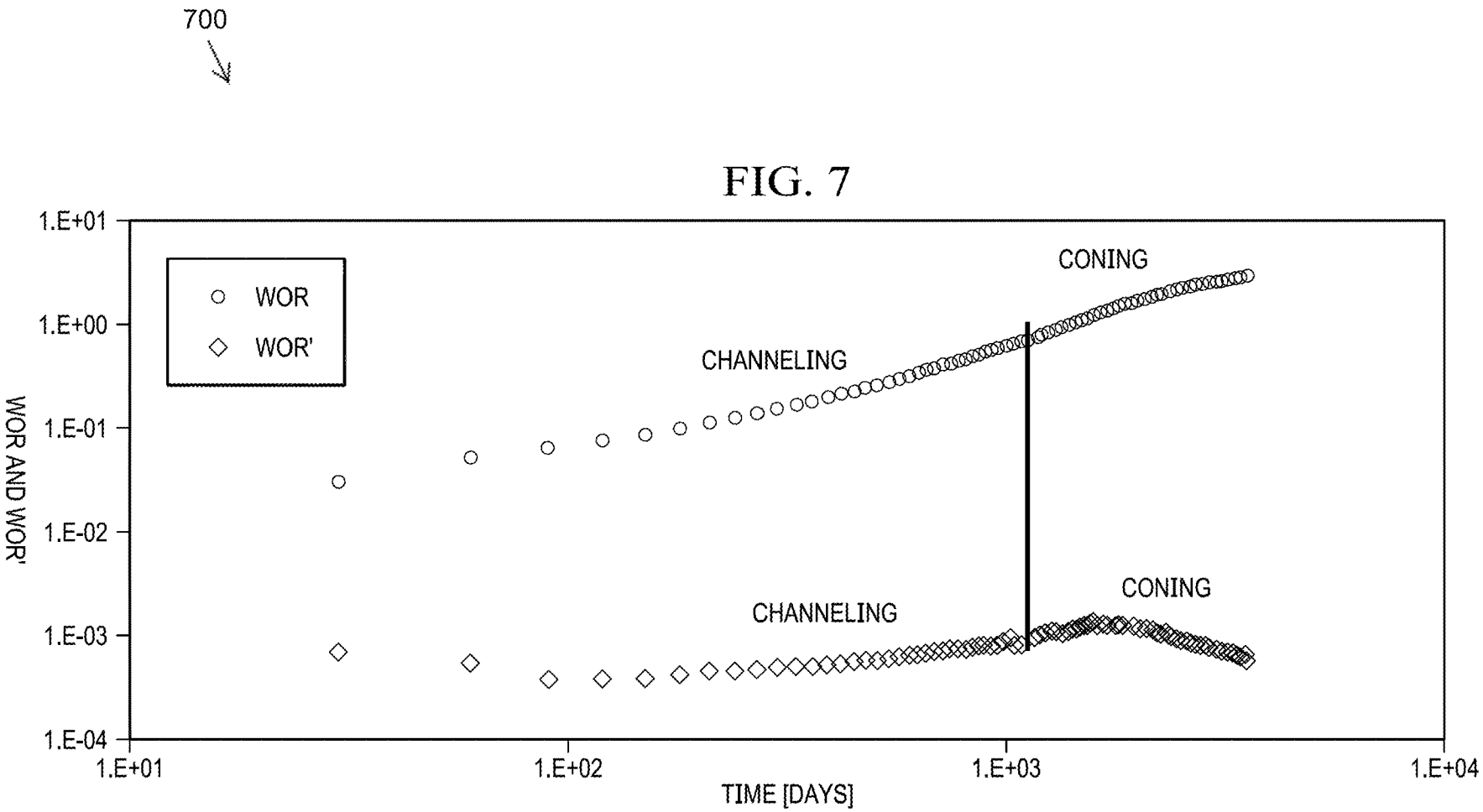
FIG. 7 illustrates the results of applying the example method of FIG. 3 to a third wellbore, according to some implementations of the present disclosure.

FIG. 7 illustrates results 700 of applying method 300 to a third well "C," according to some implementations. The water drive model for characterizing water encroachment can be identified with a mechanism of channeling and coning. In this third example scenario, the WOR and WOR' plots illustrated in FIG. 7 can be used to determine the water production mechanism based on the slope of each plot. More specifically, the WOR and WOR' plots indicate different mechanisms. For example, the WOR' plot illustrates a constant positive slope at early time for channeling and a negative slope at late time for coning.

Figure 8:
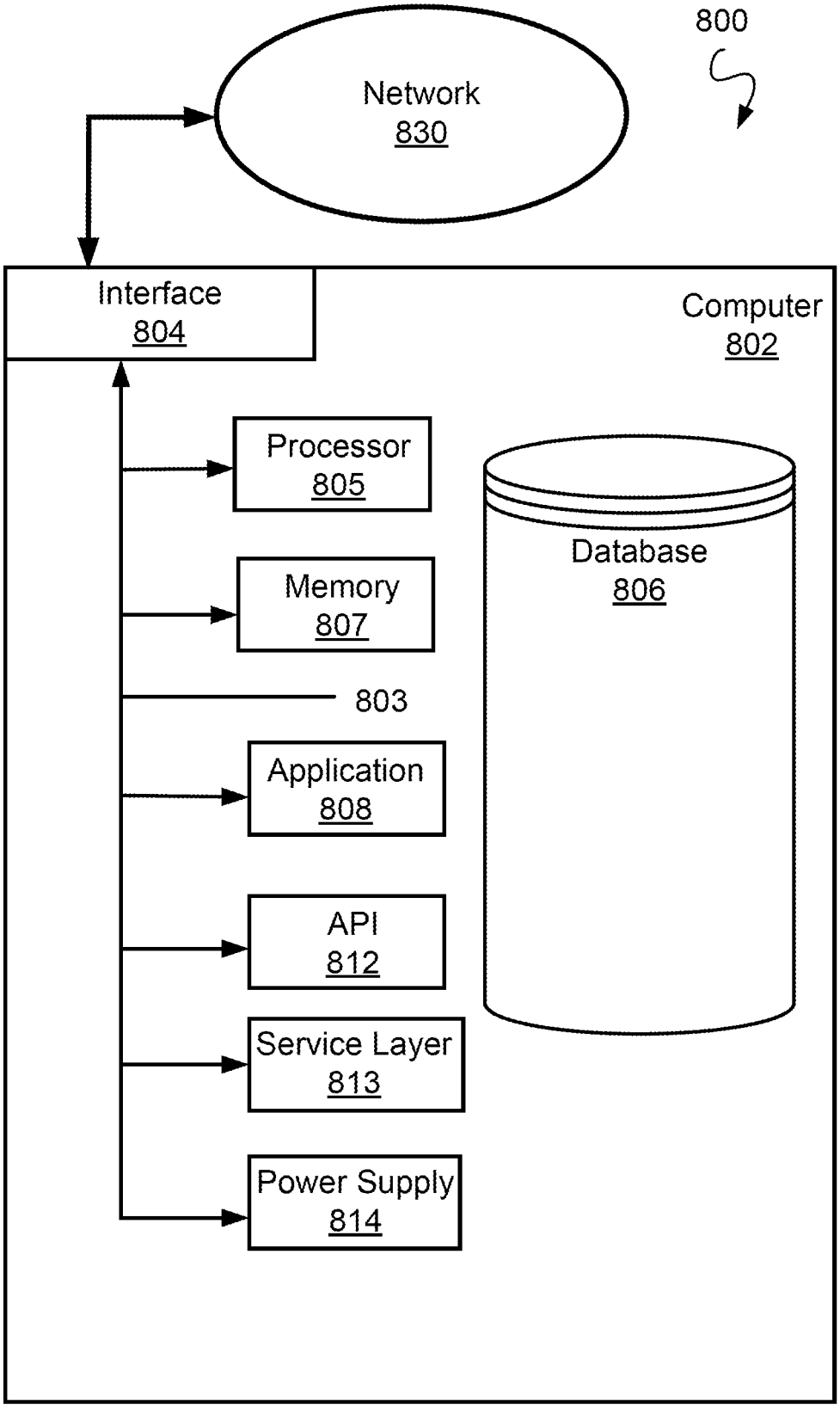
FIG. 8 is a block diagram of an example computer system, according to some implementations of the present disclosure.

FIG. 8 is a block diagram of an example computer system 800 that can be used to provide computational functionalities associated with described algorithms, methods, functions, processes, flows, and procedures described in the present disclosure, according to some implementations of the present disclosure. In some implementations, the WSI system 100 can be the computer system 800, include the computer system 800, or the WSI system 100 can communicate with the computer system 800.

The illustrated computer 802 is intended to encompass any computing device such as a server, a desktop computer, an embedded computer, a laptop/notebook computer, a wireless data port, a smart phone, a personal data assistant (PDA), a tablet computing device, or one or more processors within these devices, including physical instances, virtual instances, or both. The computer 802 can include input devices such as keypads, keyboards, and touch screens that can accept user information. Also, the computer 802 can include output devices that can convey information associated with the operation of the computer 802. The information can include digital data, visual data, audio information, or a combination of information. The information can be presented in a graphical user interface (UI) (or GUI). In some implementations, the inputs and outputs include display ports (such as DVI-I+2x display ports), USB 3.0, GbE ports, isolated DI/O, SATA-III (6.0 Gb/s) ports, mPCIe slots, a combination of these, or other ports. In instances of an edge gateway, the computer 802 can include a Smart Embedded Management Agent (SEMA), such as a built-in ADLINK SEMA 2.2, and a video sync technology, such as Quick Sync Video technology supported by ADLINK MSDK+. In some examples, the computer 802 can include the MXE-5400 Series processor-based fanless embedded computer by ADLINK, though the computer 802 can take other forms or include other components.

The computer 802 can serve in a role as a client, a network component, a server, a database, a persistency, or components of a computer system for performing the subject matter described in the present disclosure. The illustrated computer 802 is communicably coupled with a network 830. In some implementations, one or more components of the computer 802 can be configured to operate within different environments, including cloud-computing-based environments, local environments, global environments, and combinations of environments.

At a high level, the computer 802 is an electronic computing device operable to receive, transmit, process, store, and manage data and information associated with the described subject matter. According to some implementations, the computer 802 can also include, or be communicably coupled with, an application server, an email server, a web server, a caching server, a streaming data server, or a combination of servers.

The computer 802 can receive requests over network 830 from a client application (for example, executing on another computer 802). The computer 802 can respond to the received requests by processing the received requests using software applications. Requests can also be sent to the computer 802 from internal users (for example, from a command console), external (or third) parties, automated applications, entities, individuals, systems, and computers.

Each of the components of the computer 802 can communicate using a system bus. In some implementations, any or all of the components of the computer 802, including hardware or software components, can interface with each other or the interface 804 (or a combination of both), over the system bus. Interfaces can use an application programming interface (API) 812, a service layer 813, or a combination of the API 812 and service layer 813. The API 812 can include specifications for routines, data structures, and object classes. The API 812 can be either computer-language independent or dependent. The API 812 can refer to a complete interface, a single function, or a set of APIs 812.

The service layer 813 can provide software services to the computer 802 and other components (whether illustrated or not) that are communicably coupled to the computer 802. The functionality of the computer 802 can be accessible for all service consumers using this service layer 813. Software services, such as those provided by the service layer 813, can provide reusable, defined functionalities through a defined interface. For example, the interface can be software written in JAVA, C++, or a language providing data in extensible markup language (XML) format. While illustrated as an integrated component of the computer 802, in alternative implementations, the API 812 or the service layer 813 can be stand-alone components in relation to other components of the computer 802 and other components communicably coupled to the computer 802. Moreover, any or all parts of the API 812 or the service layer 813 can be implemented as child or sub-modules of another software module, enterprise application, or hardware module without departing from the scope of the present disclosure.

The computer 802 can include an interface 804. Although illustrated as a single interface 804 in FIG. 8, two or more interfaces 804 can be used according to particular needs, desires, or particular implementations of the computer 802 and the described functionality. The interface 804 can be used by the computer 802 for communicating with other systems that are connected to the network 830 (whether illustrated or not) in a distributed environment. Generally, the interface 804 can include, or be implemented using, logic encoded in software or hardware (or a combination of software and hardware) operable to communicate with the network 830. More specifically, the interface 804 can include software supporting one or more communication protocols associated with communications. As such, the network 830 or the interface's hardware can be operable to communicate physical signals within and outside of the illustrated computer 802.

The computer 802 includes a processor 805. Although illustrated as a single processor 805 in FIG. 8, two or more processors 805 can be used according to particular needs, desires, or particular implementations of the computer 802 and the described functionality. Generally, the processor 805 can execute instructions and manipulate data to perform the operations of the computer 802, including operations using algorithms, methods, functions, processes, flows, and procedures as described in the present disclosure.

The computer 802 can also include a database 806 that can hold data for the computer 802 and other components connected to the network 830 (whether illustrated or not). For example, database 806 can be an in-memory, conventional, or a database storing data consistent with the present disclosure. In some implementations, the database 806 can be a combination of two or more different database types (for example, hybrid in-memory and conventional databases) according to particular needs, desires, or particular implementations of the computer 802 and the described functionality. Although illustrated as a single database 806 in FIG. 8, two or more databases (of the same, different, or combination of types) can be used according to particular needs, desires, or particular implementations of the computer 802 and the described functionality. While database 806 is illustrated as an internal component of the computer 802, in alternative implementations, database 806 can be external to the computer 802.

The computer 802 also includes a memory 807 that can hold data for the computer 802 or a combination of components connected to the network 830 (whether illustrated or not). Memory 807 can store any data consistent with the present disclosure. In some implementations, memory 807 can be a combination of two or more different types of memory (for example, a combination of semiconductor and magnetic storage) according to particular needs, desires, or particular implementations of the computer 802 and the described functionality. Although illustrated as a single memory 807 in FIG. 8, two or more memories 807 (of the same, different, or combination of types) can be used according to particular needs, desires, or particular implementations of the computer 802 and the described functionality. While memory 807 is illustrated as an internal component of the computer 802, in alternative implementations, memory 807 can be external to the computer 802.

An application 808 can be an algorithmic software engine providing functionality according to particular needs, desires, or particular implementations of the computer 802 and the described functionality. For example, an application 808 can serve as one or more components, modules, or applications 808. Multiple applications 808 can be implemented on the computer 802. Each application 808 can be internal or external to the computer 802.

The computer 802 can also include a power supply 814. The power supply 814 can include a rechargeable or non-rechargeable battery that can be configured to be either user- or non-user-replaceable. In some implementations, the power supply 814 can include power-conversion and management circuits, including recharging, standby, and power management functionalities. In some implementations, the power-supply 814 can include a power plug to allow the computer 802 to be plugged into a wall socket or a power source to, for example, power the computer 802 or recharge a rechargeable battery.

There can be any number of computers 802 associated with, or external to, a computer system including computer 802, with each computer 802 communicating over network 830. Further, the terms "client", "user", and other appropriate terminology can be used interchangeably without departing from the scope of the present disclosure. Moreover, the present disclosure contemplates that many users can use one computer 802 and one user can use multiple computers 802.

Implementations of the subject matter and the functional operations described in this specification can be implemented in digital electronic circuitry, in tangibly embodied computer software or firmware; in computer hardware, including the structures disclosed in this specification and their structural equivalents; or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus", "computer", and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus and special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, Linux, Unix, Windows, Mac OS, Android, or iOS.

A computer program, which can also be referred to or described as a program, software, a software application, a module, a software module, a script, or code can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document; in a single file dedicated to the program in question; or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes; the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks, optical memory devices, and technologies including, for example, digital video disc (DVD), CD ROM, DVD+/−R, DVD-RAM, DVD-ROM, HD-DVD, and BLURAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), or a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface", or "GUI", can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component such as an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, or in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations; and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

What is claimed is:

1. A method comprising:

generating, based on production data for a wellbore, (i) a water-oil-ratio with respect to time (WOR) dataset for the wellbore, and (ii) a time-derivative dataset (WOR') of the WOR dataset;

generating a WOR log-log plot of the WOR dataset and a WOR' log-log plot of the WOR' dataset;

identifying at least one trend in the WOR log-log plot and the WOR' log-log plot;

determining, based on the at least one identified trend, a first type of water breakthrough;

generating, based on pressure data from a build-up pressure test in the wellbore, a log-log plot of time-derivative pressure data with respect to time (P');

determining, based on the P' log-log plot, a second type of water breakthrough;

correlating the first and second type of water breakthrough; and determining, based on the correlation, whether to perform a water treatment for the wellbore.

2. The method of claim 1, wherein the first type of water breakthrough and the second type of water breakthrough are at least one: a coning effect or a channeling effect.

3. The method of claim 1, wherein correlating the first type of water breakthrough and the second type of water breakthrough comprises:

comparing the first type of water breakthrough and the second type of water breakthrough; and determining, based on the comparison, that the first and second type of water breakthrough are identical.

4. The method of claim 3, wherein determining, based on the correlation, whether to perform a water treatment for the wellbore comprises:

in response to determining that the first and second type of water breakthrough are identical, determining to perform the water treatment for the wellbore.

5. The method of claim 1, wherein determining, based on the at least one identified trend, a first type of water breakthrough comprises:

comparing the at least one identified trend to a set of predetermined shapes, each predetermined shape associated with a respective water breakthrough type;

determining that the at least one identified trend has a threshold level of similarity to a first predetermined shape; and determining that the respective water breakthrough type of the first predetermined shape is the first type of water breakthrough.

6. The method of claim 5, wherein the set predetermined shapes comprises:

a first predetermined WOR shape indicative of a channeling effect, wherein the first predetermined WOR shape is indicative of an increasing WOR;

a second predetermined WOR shape indicative of a coning effect one, wherein the second predetermined WOR shape is indicative of a decreasing WOR;

a first predetermined WOR' shape indicative of a channeling effect, wherein the first predetermined WOR' shape has a constant positive slope; and a second predetermined WOR' shape indicative of a coning effect, wherein the second predetermined WOR' shape has a constant negative slope.

7. The method of claim 1, wherein determining, based on the P' log-log plot, a second type of water breakthrough comprises:

comparing a shape of the P' log-log plot to a set of predetermined shapes, each predetermined shape associated with a respective water breakthrough type;

determining that a first predetermined shape matches the shape of the P' log-log plot; and determining that the respective water breakthrough type of the first predetermined shape is the second type of water breakthrough.

8. The method of claim 1, wherein determining, based on the correlation, whether to perform a water treatment for the wellbore comprises determined to perform the water treatment for the wellbore, and the method further comprising:

determining, based on the correlation, a type of water treatment.

9. The method of claim 8, further comprising:

controlling at least one drilling tool to perform the determined type of water treatment.

10. One or more non-transitory computer-readable storage media coupled to one or more processors and having instructions stored thereon which, when executed by the one or more processors, cause the one or more processors to perform operations comprising:

generating, based on production data for a wellbore, (i) a water-oil-ratio with respect to time (WOR) dataset for the wellbore, and (ii) a time-derivative dataset (WOR') of the WOR dataset;

generating a WOR log-log plot of the WOR dataset and a WOR' log-log plot of the WOR' dataset;

identifying at least one trend in the WOR log-log plot and the WOR' log-log plot;

determining, based on the at least one identified trend, a first type of water breakthrough;

generating, based on pressure data from the wellbore, a plot of time-derivative pressure data with respect to time (P');

determining, based on the P' plot, a second type of water breakthrough;

correlating the first and second type of water breakthrough; and determining, based on the correlation, whether to perform a water treatment for the wellbore.

11. The one or more non-transitory computer-readable storage media of claim 10, wherein the first type of water breakthrough and the second type of water breakthrough are at least one: a coning effect or a channeling effect.

12. The one or more non-transitory computer-readable storage media of claim 10, wherein correlating the first type of water breakthrough and the second type of water breakthrough comprises:

comparing the first type of water breakthrough and the second type of water breakthrough; and determining, based on the comparison, that the first and second type of water breakthrough are identical.

13. The one or more non-transitory computer-readable storage media of claim 12, wherein determining, based on the correlation, whether to perform a water treatment for the wellbore comprises:

in response to determining that the first and second type of water breakthrough are identical, determining to perform the water treatment for the wellbore.

14. The one or more non-transitory computer-readable storage media of claim 10, wherein determining, based on the at least one identified trend, a first type of water breakthrough comprises:

comparing the at least one identified trend to a set of predetermined shapes, each predetermined shape associated with a respective water breakthrough type;

determining that the at least one identified trend has a threshold level of similarity to a first predetermined shape; and determining that the respective water breakthrough type of the first predetermined shape is the first type of water breakthrough.

15. The one or more non-transitory computer-readable storage media of claim 14, wherein the set predetermined shapes comprises:

a first predetermined WOR shape indicative of a channeling effect, wherein the first predetermined WOR shape is indicative of an increasing WOR;

a second predetermined WOR shape indicative of a coning effect one, wherein the second predetermined WOR shape is indicative of a decreasing WOR;

a first predetermined WOR' shape indicative of a channeling effect, wherein the first predetermined WOR' shape has a constant positive slope; and a second predetermined WOR' shape indicative of a coning effect, wherein the second predetermined WOR' shape has a constant negative slope.

16. The one or more non-transitory computer-readable storage media of claim 10, wherein determining, based on the P' plot, a second type of water breakthrough comprises:

comparing a shape of the P' plot to a set of predetermined shapes, each predetermined shape associated with a respective water breakthrough type;

determining that a first predetermined shape matches the shape of the P' plot; and determining that the respective water breakthrough type of the first predetermined shape is the second type of water breakthrough.

17. A system comprising:

one or more processors configured to perform operations comprising:

generating (i) a water-oil-ratio with respect to time (WOR) dataset for a wellbore, and (ii) a time-derivative dataset (WOR') of the WOR dataset;

determining, based on the WOR dataset and the WOR' dataset, a first type of water breakthrough;

generating, based on pressure data from the wellbore, a plot of time-derivative pressure data with respect to time (P');

determining, based on the P' plot, a second type of water breakthrough;

correlating the first and second type of water breakthrough; and determining, based on the correlation, whether to perform a water treatment for the wellbore.

18. The system of claim 17, wherein the first type of water breakthrough and the second type of water breakthrough are at least one: a coning effect or a channeling effect.

19. The system of claim 17, wherein correlating the first type of water breakthrough and the second type of water breakthrough comprises:

comparing the first type of water breakthrough and the second type of water breakthrough; and determining, based on the comparison, that the first and second type of water breakthrough are identical.

20. The system of claim 17, wherein determining, based on the WOR dataset and the WOR' dataset, a first type of water breakthrough comprises:

generating a WOR log-log plot of the WOR dataset and a WOR' log-log plot of the WOR' dataset;

identifying at least one trend in the WOR log-log plot and the WOR' log-log plot;

comparing the at least one identified trend to a set of predetermined shapes, each predetermined shape associated with a respective water breakthrough type;

determining that the at least one identified trend has a threshold level of similarity to a first predetermined shape; and determining that the respective water breakthrough type of the first predetermined shape is the first type of water breakthrough.

* * * * *